US008544971B2

(12) United States Patent
Stocker

(10) Patent No.: US 8,544,971 B2
(45) Date of Patent: Oct. 1, 2013

(54) HOUSEHOLD APPLIANCES

(75) Inventor: Richard Stocker, Lienz (AT)

(73) Assignee: Liebherr-Hausgerate Lienz GmbH, Lienz (AT)

( * ) Notice: Subject to any disclaimer, the term of this patent is extended or adjusted under 35 U.S.C. 154(b) by 360 days.

(21) Appl. No.: 12/906,408

(22) Filed: Oct. 18, 2010

(65) Prior Publication Data

US 2011/0113816 A1 May 19, 2011

(30) Foreign Application Priority Data

Oct. 19, 2009 (DE) ..... 10 2009 049 813
Nov. 18, 2009 (DE) ..... 10 2009 053 714

(51) Int. Cl.
*A47B 96/04* (2006.01)

(52) U.S. Cl.
USPC ..... 312/405; 312/329

(58) Field of Classification Search
USPC 312/326–329, 138.1, 405, 325; 16/82–86 C, 16/49, 51, 54, 61, 66, 68, 70, 65, 50, 286, 16/289, 290
See application file for complete search history.

(56) References Cited

U.S. PATENT DOCUMENTS 4,506,407 A * 3/1985 Downey ..... 16/49
4,878,265 A * 11/1989 Nesbitt ..... 16/49
4,967,512 A * 11/1990 Schroder et al. ..... 16/82
5,522,656 A * 6/1996 Jenkins ..... 312/405
6,845,545 B2 * 1/2005 Han et al. ..... 312/405
7,743,464 B2 * 6/2010 Tomioka et al. ..... 16/64
7,866,003 B2 * 1/2011 Tooyama ..... 16/422
8,001,654 B2 * 8/2011 Tomioka et al. ..... 16/64
8,186,010 B2 * 5/2012 Tomiji et al. ..... 16/64
8,256,064 B2 * 9/2012 Blersch et al. ..... 16/286
8,272,165 B2 * 9/2012 Tomioka ..... 49/275
2001/0008037 A1 * 7/2001 Brustle ..... 16/71
2003/0056328 A1 3/2003 Habegger et al.
2008/0263819 A1 * 10/2008 Tomioka et al. ..... 16/71

FOREIGN PATENT DOCUMENTS

DE 202007005957 6/2008
DE 202007013948 2/2009

* cited by examiner

*Primary Examiner* — Hanh V Tran
(74) *Attorney, Agent, or Firm* — Dilworth & Barrese, LLP.

(57) ABSTRACT

A refrigerating and/or freezing device, with at least one door, through which the interior of the device can be closed, and with a door closure system that comprises includes at least one closure that moves the door into its closed position, a damping device that opposes a counterforce to the door movement, a movable carriage connected with the closure system to move the closure into a pre-tensioned state when the door is opened, as well as an interlocking component connected with the damping device and with the closure such that the closure can be fixed by the interlocking component in its pre-tensioned state, whereby the carriage and the interlocking component are coupled together by a first movement section of the door and are decoupled from each other by a second movement section of the door.

20 Claims, 9 Drawing Sheets

HOUSEHOLD APPLIANCES

BACKGROUND OF THE INVENTION

The within invention relates to a household appliance, particularly a refrigerating and/or freezing device.

Refrigerating and/or freezing devices are known from the current art that have a door closure system that automatically pulls the door into its fully closed position when a certain closing angle is exceeded. Moreover, providing such closure systems with a damping device is known from the current art, which damping device has the task of undertaking the closing movement of the door in a damped manner so that the slamming of the door is prevented.

One disadvantage of the known door closure systems is that they have a relatively large overall length which makes use difficult in relatively narrow doors.

SUMMARY OF THE INVENTION

The within invention therefore relates to developing a household appliance, particularly a refrigerating and/or cooling device, in which the overall length of the closure system is reduced compared to known solutions.

This task is solved by a household appliance with the characteristics herein.

According to it, provision is made for the closure system to comprise the following components:

At least one means of closure that preferably moves the door from a specific angle of opening of the door into its closed position, at least one damping system that preferably opposes a counterforce over part of the range of the door opening movement and thus dampens the door movement, at least one movable carriage connected with the closure system such that the means of closure is pre-tensioned by the carriage when the door is opened, as well as at least one interlocking component connected with the damping system and with the means of closure such that the means of closure can be fixed by the interlocking component in its pre-tensioned state, whereby the carriage and the interlocking component are designed such that they are coupled together by means of a first movement section of the door and are decoupled from each other by means of a second movement section of the door.

The possibility of decoupling the carriage and interlocking component means that neither the means of closure nor the damping device are entrained together over the entire range of movement of the door. The decoupling ensures that the damping device and the means of closure remain in one position starting from a certain angle of opening of the door and that the carriage is thus moved independently of the damping device and the means of closure.

The term "door" covers any desired closure component, such as a traditional door movable around a vertical swivel axis or a cover movable around a horizontal swivel axis.

Thus, the known disadvantage of the known devices, that the damping device is jointly entrained over the entire range of opening of the door, is avoided since the decoupling of the carriage and interlocking component enables the carriage to be moved while the damping device and means of closure do not undergo any further movement. Based on the fact that the damping device is not jointly entrained over the entire range of movement of the door, it can have a relatively short overall length, which has the advantage that the entire closure system can also be built compactly. This makes possible the use, in particular, of narrow doors as are present, for example, on the devices known as French doors.

The means of closure can have one or more springs or consist thereof. The damping device can, for example, have a piston that is movably accommodated in a cylinder space. It can preferably be designed as an oil-filled damping device. For example, it is possible for the damping device to have a piston with a plunger arranged therein that is located directly or indirectly on the interlocking component.

In another embodiment of the invention, provision is made for the means of closure and/or the damping device to be connected directly or indirectly with the interlocking component.

In a preferred embodiment, provision is made for the means of closure and/or the damping device to be located on a movable tensioning carriage, which is in turn preferably connected in a pivotable manner with the interlocking component. As long as the carriage and the interlocking component are coupled together, the tensioning carriage is also entrained by the movement of the door. When opening the door, this causes the means of closure to be moved into a pre-tensioned position so that it can automatically close the door again if necessary. The tensioning carriage can be connected in a pivotable manner with the interlocking component. Provision can be made here for the tensioning carriage itself not to be located in a pivotable manner, but rather for the interlocking component to be.

In another embodiment of the invention, provision is made for the carriage and the interlocking component to be pivotable in relation to each other, and they are thus designed so that the coupling and decoupling of both structural components, i.e., of the carriage and the interlocking component, to take place by means of such a pivoting movement.

In the process, provision is preferably made for the carriage not to be pivotable, but rather for the interlocking component to be. The carriage can be accommodated in a guide, as can the above-mentioned tensioning carriage, which enables the translatory movement of the carriage.

In another embodiment of the invention, provision is made for the closure system to have a first guide that prevents a pivoting movement of the interlocking component in the first movement section of the door, which leads to decoupling from the carriage, and for a second guide to be provided that enables a pivoting movement of the interlocking component in the second movement section of the door that leads to the decoupling of the carriage. In the first movement section of the door, the carriage and interlocking component are coupled together. A pivoting movement of the interlocking component can be prevented by a first guide that, for example, can be designed as a linear guide. Starting from the angle of opening of the door at which decoupling is desired, provision can be made for the interlocking component to be moved into a second guide that permits such a pivoting movement and thus enables the decoupling of the carriage and the interlocking component. Starting from this point, the carriage and thus the door movement is independent of the movement of the damping device and the means of closure or the spring.

The first guide and the second guide can be directly adjacent to each other. It is possible for the first guide to be designed as a straight groove and the second guide to be a groove extending in the circumferential direction of the closure system. The second guide can, for example, also be designed in a spiral. In any event, the second guide is designed such that pivoting movement of the interlocking component in the second guide is possible.

In the preferred embodiment of the invention, provision is further made for the carriage or the interlocking component to have a threaded end and for the other part to have a threaded hole in which the threaded end, in the coupled state of the carriage and the interlocking component, is accommodated at least in part, while the thread is designed such that a pivoting movement of the carriage and the interlocking component relative to each other is caused by a force acting in the direction of movement of the carriage. The threaded end and threaded hole or opening are thus preferably designed such that the joining and separation of the two parts (carriage and interlocking component) are constrained by forces in the direction of movement, i.e., in the axial direction of the threaded end. Preferably, therefore, no force need be applied in a radial direction, as when screwing. Preferably, a force in the direction of movement of the carriage caused by the movement of the door is adequate.

In another embodiment of the invention, provision is made for the closure system to have at least one lever connected to the carriage. This lever is located such that it translates the pivoting movement of the door into a translatory movement of the carriage.

The lever can be connected with a lever mechanism that is connected, on the one hand, with the door of the device and, on the other hand, with the body of device.

The closure system can be designed as a structural unit. It can preferably be located in the door of the device. It is possible for a foamed-in part to be provided in the door that is foamed solidly to the door and is located in the closure system as a fixed unit. The closure system can have a housing and a mounting in addition to the above-mentioned parts. This mounting serves for the pivotable accommodation of the above-mentioned lever mechanism on which the lever is arranged in a pivotable manner, which lever is in turn connected to the carriage.

BRIEF DESCRIPTION OF THE DRAWINGS

The further details and advantages of the within invention are explained in greater detail based on an embodiment shown in the drawing. The figures show.

DESCRIPTION OF THE PREFERRED EMBODIMENTS

Figure 1:
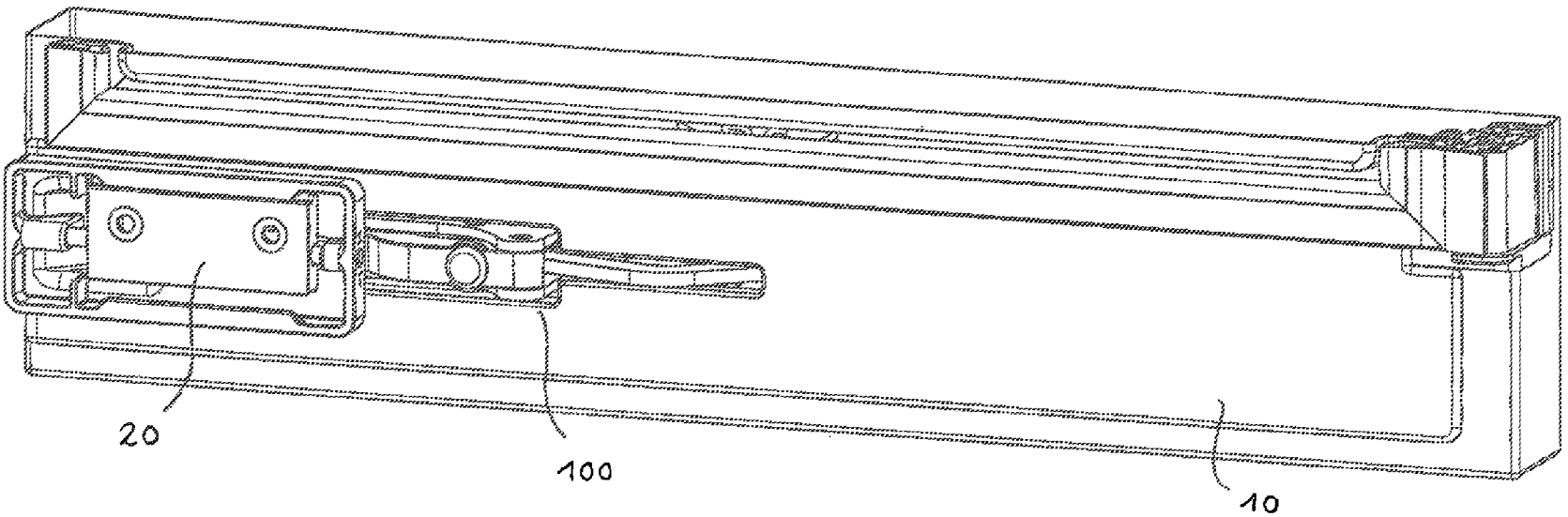
FIG. 1: A perspective view of the door closure system according to the within invention with door mounting.

FIG. 1 shows a perspective view of the inside of the door 10. As can be seen from FIG. 1, the closure system 100 according to the within invention is located in the area of the door 10 shown, on the inside thereof, concealed behind a cover. Reference number 20 marks a mounting element to be mounted on the body side, on which element the mechanism is located, as can be clearly seen from the other drawings.

Figure 2:
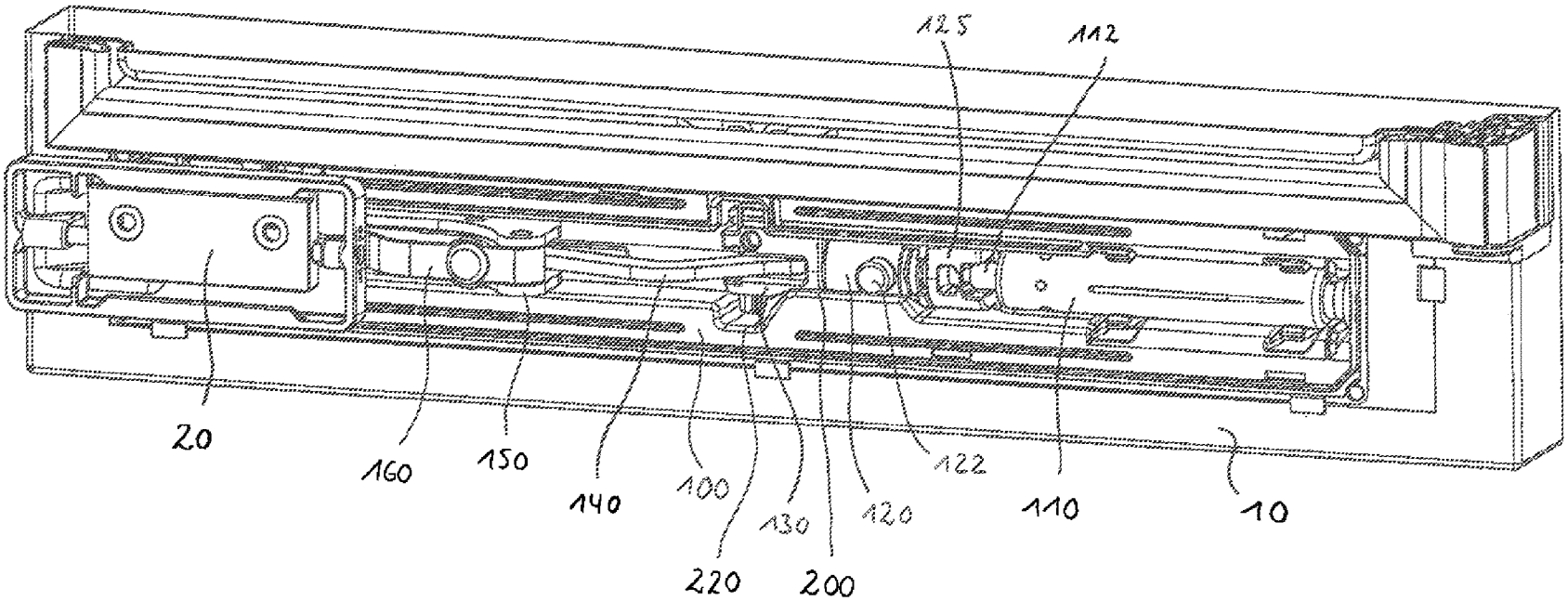
FIG. 2: A view according to FIG. 1, but without covers.

FIG. 2 shows the location without a cover and makes it clear which components the closure system has according to the within invention.

Reference number 110 marks a damping device, which can be designed, for example, as an oil-filled damping device and which has a piston located movably in a cylinder space, which piston is connected with plunger 112.

Reference number 120 marks the interlocking element that has one or more guide pins 122 on its outside. These guide pins run to a first guide 200 and, depending on the angle of opening of the door or depending on the position of the interlocking element 120, to a second guide 220. The interlocking element 120 is connected with a tensioning carriage 125 in a pivotable manner. The springs 170 (see FIG. 3) as well as the plunger 112 of the damping device unit 110 are located on the tensioning carriage 125.

Reference number 130 marks a carriage that is either coupled to or decoupled from the interlocking element 120, which state depends on the angle of opening of the door. Reference number 140 marks a lever that is, in turn, connected with a lever mechanism 150, 160 and that transfers the door opening movement to the carriage 130. The lever 160 is located in a pivotable manner on the mounting element 20 to be fixed on the body side. The levers 150 are located on the closure system 100, as can be seen more clearly in the other drawings.

The door 10 contains a foamed-in door part that is solidly connected with the door and in which the closure system 100 is located. The closure system 100 can be composed of the above-described components as well as a housing.

Figure 3:
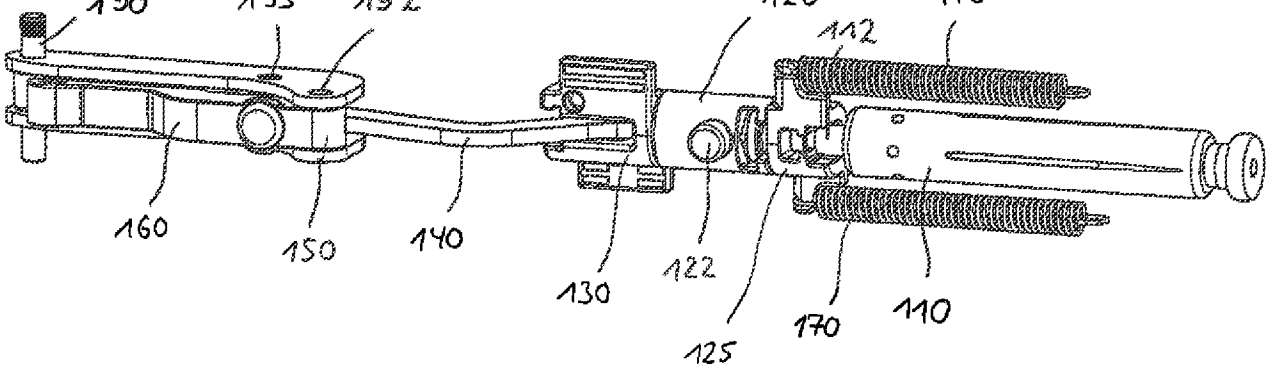
FIG. 3: A perspective representation of the components of the closure system, without housing.

FIG. 3 shows the closure system 100 in an uninstalled state.

This figure shows the springs 170 that are moved into a pre-tensioned position upon opening the door by means of the carriage 130 and held there by means of the interlocking component 120. As stated above, reference number 125 marks a tensioning carriage on which, for one thing, the plunger 112 is located as are, for another, the springs 170. The other end of the springs 170 not connected with the tensioning carriage 125 is located in a fixed position. The movement of the carriage 130 is transferred by means of the interlocking component 120 and the tensioning carriage 125 to the springs 170 and to the plunger of the damping device 110.

If the tensioning carriage 125 is moved, it leads to a corresponding movement or expansion of the springs as well as the plunger 112.

The tensioning carriage 125 is pivotable in relation to the interlocking component 120, but is connected solidly to it in the axial direction, so that the tensioning carriage 125 follows the axial movements of the interlocking component 120, i.e., movements in the direction of movement of the carriage 130.

Reference number 192 marks an axis around which the lever 160 can be pivoted in relation to the levers 150. Reference number 193 marks a swiveling axis around which the lever 140 is connected in a pivotable manner with the levers 150, and reference number 190, finally, marks a swiveling axis around which the lever 150 is located in a pivotable manner on the closure system 100.

Figure 4:
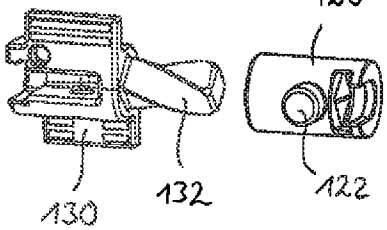
FIG. 4: A perspective representation of the carriage and interlocking component in the decoupled state.

FIG. 4 shows a detailed representation of the carriage 130 as well as the interlocking component 120. As shown by FIG. 4, the carriage 130 has a threaded section or end 132. The interlocking component 120 has a corresponding interior threaded section on its inside. Reference number 122 marks the pin(s) located on the outside of the interlocking component 120 that run(s) in the fixed guides 200, 220.

The term "thread" is to be interpreted broadly and includes any arrangement of the end 132 and the interlocking component 120 that leads the two parts 120, 130 together in a pivoting movement when an axial force acts on one of the parts 120, 130. It is also possible to design projections in the one part and grooves in the other part or to design the thread as a spiral section, as shown in FIG. 4, etc. In principle, it is also possible to provide the ends 132 on the interlocking component 120, and the hole or recess for accommodation of the end on the carriage.

FIGS. 5 through 9 now show a closure system according to the within invention with various angles of opening of the door. For a better overview, the parts of the closure system already visible from FIGS. 1 through 4 are not provided with reference numbers again.

Figure 5:
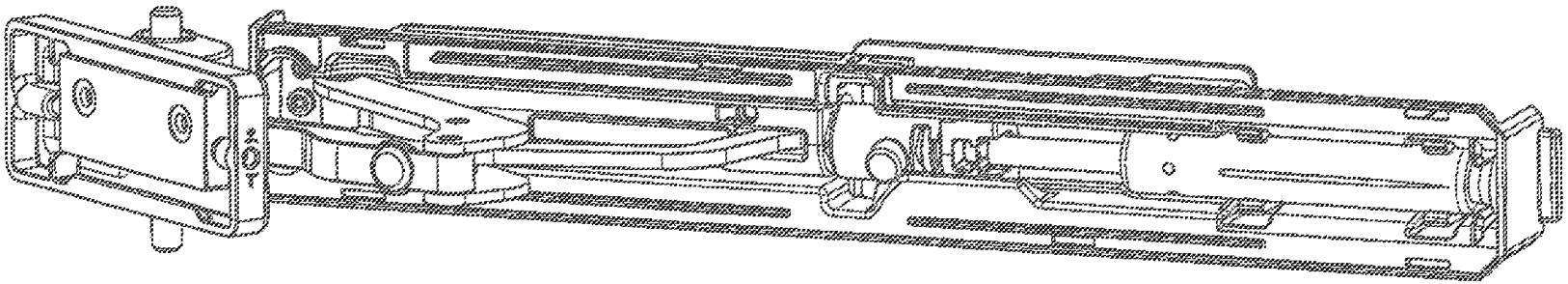
FIG. 5-FIG. 9: A perspective view of the door closure system in various positions with increasing angle of opening of the door.

FIG. 5 shows the closure system in a state in which the door was already opened to a certain extent from the closed state according to FIG. 2. The opening of the door causes a movement of the lever 140 and thus of the carriage 130 guided in a translatory manner to the left, according to FIG. 5. The carriage 130, upon its translatory movement, entrains the interlocking component 120 that is prevented from making a pivoting movement by the fact that the pins 122 are located on the first straight guide 200. The carriage 130 thus entrains the interlocking component 120. As shown above, the interlocking element 120 is connected with a tensioning carriage 125. The tensioning carriage 125 is thus entrained by the movement of the carriage 130 and by the movement of the interlocking component 120 and thus moves the plunger 112 of the damping device 110 as well as the springs 170. The plunger 112 is extended in the process and the springs 170 are shifted into a pre-tensioned state.

Figure 6:
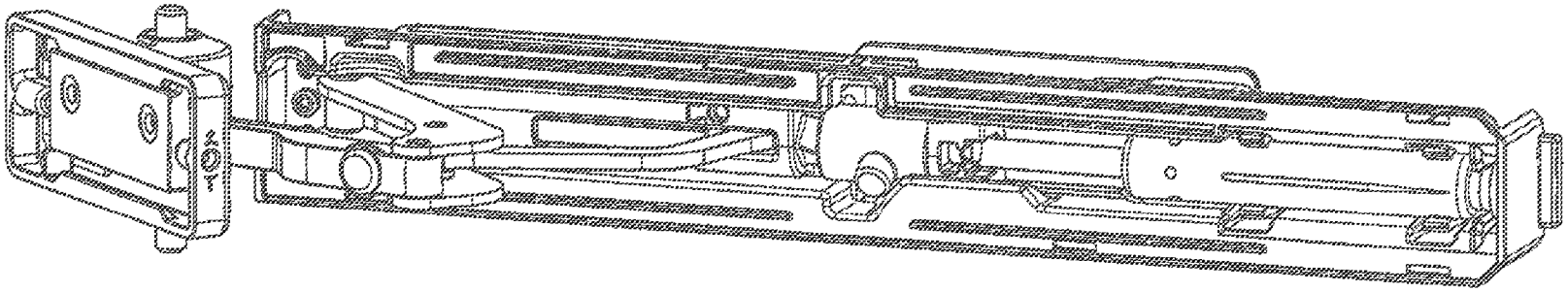

As can be seen from a comparison of FIGS. 5 and 6, the further swiveling movement of the door leads to the movement of the interlocking component 120 with its pins 122 into the area of the second guide 220. The second guide 220 is designed such that, unlike the first guide 200, it permits a pivoting movement of the interlocking component 120. Based on the force exerted by the carriage 130 and caused by the opening of the door, the interlocking component 120 moves in a pivoting manner into the second guide 220 and thus leads to an "unscrewing" of the threaded section 132 of the carriage 130 from the area of the interior thread of the interlocking component 120. Both parts, i.e., the carriage 130 and the interlocking component 120, are thus decoupled.

Figure 7:
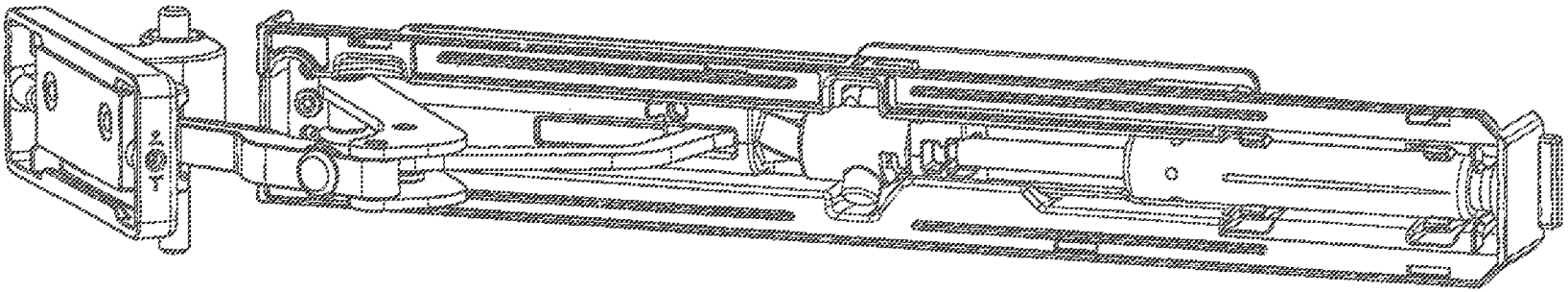

FIG. 7 shows this decoupling process in a more advanced stage in which the door was already opened to a certain extent.

Figure 8:
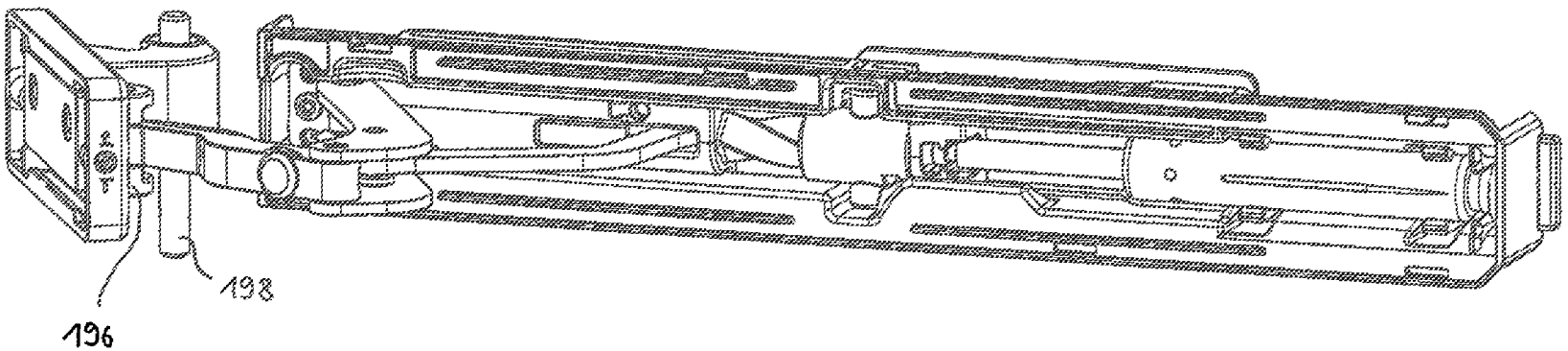

In FIG. 8, the decoupling process between the carriage 130 and the interlocking component 120 is already completed so that the carriage 130 can be moved independently of the interlocking component 120 and thus also independently of the plunger 112 of the damping device 110 as well as the springs 170.

Starting from the position according to FIG. 2, the interlocking component 120 is now rotated 90°.

The rotary axis of the interlocking component 120 lies in the direction of movement of the carriage 130.

Figure 9:
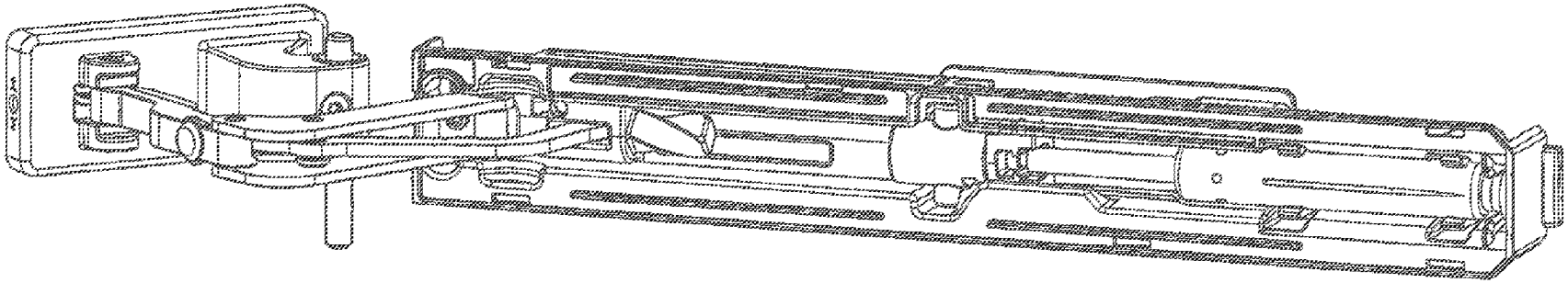

Finally, FIG. 9 shows a state in which the door is opened to its end stop. In this case, the carriage 130 lies in the end range of its guide and it is impossible to open the door further.

FIG. 8, with reference numbers 196 and 198, shows the swiveling axis around which the lever 160 is fixed to the mounting element 20 on the body side (swiveling axis 196) or the swiveling axis 198 of the door.

As can be seen from the above figures, the means of closure (springs 170) do not exert a closing force over the entire range of opening movement of the door, but rather only from the angle of opening of the door from which the interlocking component 120 is turned back again during closing so that it can be guided into the first guide section 200. As soon as this state is reached, the springs pull the tensioning carriage 125 and thus also the interlocking component 120 and therefore the carriage 130 and consequently the door into its closed position. At smaller angles of opening of the door, the interlocking component 120 runs into the guide section 200, and at relatively larger angles of opening, the interlocking component 120 is located in the second guide section 220.

As also described above, the springs 170 are not located in the area of the lever or the deflection unit, but rather in the area of the damping device 110. With this or its plunger 112, they are firmly connected by means of the tensioning carriage 125.

As shown in the above-described drawings, particularly FIGS. 8 and 9, the springs 170 are pre-tensioned upon the opening of the door 10 and are held in this position when the starting angle for automatic closing is reached through the fact that the pins 122 of the interlocking component 120 are accommodated in the second groove 220 which prevents a translatory movement of the interlocking component 120 in the closed position.

The interlocking component 120 thus guarantees the maintenance of the position of the pre-tensioned springs 120 and the damping device 110 until the user recloses the door and the rotary movement of the interlocking component 120, acted upon by the carriage 130, enables a contraction of the springs and thus the closing of the door.

The within invention is thus based on a combined coupling and interlocking system that comprises the carriage and the interlocking unit.

In the closed state of the door, the mounting, the deflection system or the lever arrangement, the coupling-interlocking combination, the spring system and the damping device form one unit since they are all mechanically connected together.

All components are preferably mounted on or guided into a housing.

Upon opening the door, by means of a bearing block and the above-mentioned deflection lever system, a linear movement of the carriage 130, the interlocking component 120, the tensioning carriage 125 and the damping device plunger 112 is initiated. The springs 170 are thus tensioned and the damping device 110 or its plunger 112 are moved into the front end position. Through the screw or spiral shapes on both sides, the carriage 130 and the interlocking component 120 are first coupled together, where the shape of the thread or the spiral form is selected such that the coupling and decoupling of the two parts, i.e., the rotary movement of the parts in relation to each other by forces in the axial direction, i.e., in the direction of the movement of the carriage 130, is already forced.

The tractive forces in the coupling-interlocking combination resulting from the pre-tensioning of the springs 170 force a rotary movement of the two parts relative to each other that, however, in the pre-tensioning phase of the closing springs, as shown, for example, in FIG. 2, is stopped by the guidance of the interlocking ends 122 into the first guide section 200.

As described above, the this first guide 200 opens, at the end of the pre-tensioning phase, into a second guide 220 that permits a rotational movement of the interlocking component 120. Through this rotation of the interlocking component 120, for one thing, the springs 170 and the damping device or its plunger 112 are interlocked or held in a certain position and, for another thing, the carriage 130 is decoupled.

The shape of the automatically opening guide 220 is preferably a spiral surface.

As described above, the interlocking component 120 is rotated by the screw or spiral shape until its end 122 is located in an undercut and the springs 170 remain in this position due to the tractive force. Based on the decoupling of the carriage, there is no further tensioning of the springs 170 during a further opening movement of the door nor any further movement of the plunger 112 of the damping device 110.

This means that the carriage 130 can be moved freely after decoupling. Otherwise, the springs 170 and the damping device 110 or the plunger 112 thereof would have to follow the entire linear travel of the carriage 130 until the final door position was reached, which would require a corresponding large structure for the damping device 110. By separating these parts outside the automatic closing phase, the length of the damping device 110 with the plunger 112 can be reduced to the necessary minimum.

As set forth above, upon closing the door, the carriage 130 is pressed into the interlocking part 120 by means of the bearing block and the deflection lever system, whereby a new rotary movement is forced. By screwing the end part 132 of the carriage 130 in, the carriage 130 is reconnected with the interlocking component 120, caused by the rotary movement of the closure component 120, and, at the same time, the de-interlocking process is initiated, which leads to the springs 170 being able to pull the arrangement into the closed position. As soon as this coupling process is completed, the two parts, i.e., the carriage 130 and the interlocking component 120, are again firmly connected together. Decoupling of these two parts is no longer possible due to the guidance of the interlocking ends 122 into the first guide 200. As soon as this de-interlocking, i.e., the release of the interlocking end 122 from the second guide 220, has taken place, the springs 170 pull the door closed. This closing movement is comparatively gentle due to the integrated damping device 110.

So that the carriage 130 does not enter the interlocking component 120 without braking, provision can be made for the friction between the housing and the carriage 130 to be increased by a suitable pairing of materials (e.g., rubber components) and thus, braking is forced.

It is possible for the automatic closure function to be provided starting from an angle of opening of the door of approximately 40°, damping in this area and an end stop at the opening end of the door movement. This value is obviously just an example. Other angles of opening of the door from which the automatic closing function starts are possible.

The tensioning carriage 125 and the interlocking component 120 are pivotable in relation to each other, but in the axial direction, i.e., they are firmly connected together in the direction of movement of the carriage 130 and of the tensioning carriage 125. This means that the interlocking component 120 is pivotable in relation to the tensioning carriage 125, but the parts cannot be separated from each other in the axial direction.

In the embodiments shown here, the tensioning carriage 125 is moved such that it cannot be pivoted. However, the interlocking component 120 is pivotable as soon as the pins 122 have reached the second guide section 220.

The invention claimed is:

1. A household appliance, particularly a refrigerating and/or freezing device, with at least one door, through which the interior of the device can be closed, and at least one door closure system that comprises the following components: at least one means of closure that moves the door into its closed position, at least one damping device that opposes a counterforce and thus dampens the door movement, at least one movable carriage connected with the closure system such that the means of closure is moved into a pre-tensioned state by the carriage when the door is opened, at least one interlocking component connected with the damping device and with the means of closure such that the means of closure can be fixed by the interlocking component in its pre-tensioned state, wherein the carriage and the interlocking component are designed such that they are coupled together by a first movement section of the door and are decoupled from each other by a second movement section of the door.

2. A household appliance, said appliance being a refrigerating and/or freezing device, with at least one door, through which the interior of the device can be closed, and with at least one door closure system that comprises the following components: at least one means of closure that moves the door into its closed position, at least one damping device that opposes a counterforce and thus dampens the door movement, at least one movable carriage connected with the closure system such that the means of closure is moved into a pre-tensioned state by the carriage when the door is opened, as well as at least one interlocking component connected with the damping device and with the means of closure such that the means of closure can be fixed by the interlocking component in its pre-tensioned state, whereby the carriage and the interlocking component are designed such that they are coupled together by a first movement section of the door and are decoupled from each other by a second movement section of the door, wherein the carriage or the interlocking component has a threaded end and the other part has a threaded hole in which the threaded end, in the coupled state of the carriage and the interlocking component, is accommodated at least in part, while the thread is designed such that a pivoting movement of the carriage and the interlocking component relative to each other is caused by a force acting in the direction of movement of the carriage.

3. A household appliance of claim 1 wherein the means of closure has one or more springs and wherein the damping device has a piston that is movably accommodated in a cylinder space and which is designed as an oil-filled damping device.

4. A household appliance of claim 1 wherein the means of closure or the damping device is connected directly or indirectly with the interlocking component.

5. A household appliance of claim 1 wherein the means of closure or the damping device is located on a movable tensioning carriage which is, in turn, connected in a pivotable manner with the interlocking component.

6. A household appliance of claim 1 wherein the carriage and the interlocking component are pivotable in relation to each other and are designed such that the coupling and decoupling of the carriage and interlocking component is caused by such a rotational movement.

7. A household appliance of claim 1 wherein a first guide is provided that prevents a pivoting movement of the interlocking component in the first movement section of the door, which leads to decoupling from the carriage, and a second guide is provided that enables a pivoting movement of the interlocking component in the second movement section of the door that leads to the decoupling of the carriage.

8. A household appliance of claim 1 wherein the closure system also has at least one lever connected with the carriage.

9. A household appliance of claim 8 wherein the lever is connected with a lever mechanism that is connected, on the one hand, with the door of the device and, on the other hand, with the body of device.

10. A household appliance of claim 1 wherein the closure system is designed as a structural unit that is located in the door.

11. A household appliance of claim 2 wherein the means of closure has one or more springs and wherein the damping device has a piston that is movably accommodated in a cylinder space and which is designed as an oil-filled damping device.

12. A household appliance of claim 11 wherein the means of closure or the damping device is connected directly or indirectly with the interlocking component.

13. A household appliance of claim 3 wherein the means of closure or the damping device is connected directly or indirectly with the interlocking component.

14. A household appliance of claim 2 wherein the means of closure or the damping device is connected directly or indirectly with the interlocking component.

15. A household appliance of claim 14 wherein the means of closure or the damping device is located on a movable tensioning carriage which is, in turn, connected in a pivotable manner with the interlocking component.

16. A household appliance of claim 13 wherein the means of closure or the damping device is located on a movable tensioning carriage which is, in turn, connected in a pivotable manner with the interlocking component.

17. A household appliance of claim 12 wherein the means of closure or the damping device is located on a movable tensioning carriage which is, in turn, connected in a pivotable manner with the interlocking component.

18. A household appliance of claim 11 wherein the means of closure or the damping device is located on a movable tensioning carriage which is, in turn, connected in a pivotable manner with the interlocking component.

19. A household appliance of claim 4 wherein the means of closure or the damping device is located on a movable tensioning carriage which is, in turn, connected in a pivotable manner with the interlocking component.

20. A household appliance of claim 3 wherein the means of closure or the damping device is located on a movable tensioning carriage which is, in turn, connected in a pivotable manner with the interlocking component.

* * * * *